US012084236B2

(12) United States Patent
Dehlin

(10) Patent No.: US 12,084,236 B2
(45) Date of Patent: Sep. 10, 2024

(54) INSERT AND PACKAGE FORMED OF AN INSERT IN A SLEEVE

(75) Inventor: Marcus Dehlin, Karlstad (SE)

(73) Assignee: Stora Enso AB, Falun (SE)

( * ) Notice: Subject to any disclaimer, the term of this patent is extended or adjusted under 35 U.S.C. 154(b) by 4815 days.

(21) Appl. No.: 12/520,363

(22) PCT Filed: Dec. 20, 2007

(86) PCT No.: PCT/SE2007/051055

§ 371 (c)(1),
(2), (4) Date: Jun. 19, 2009

(87) PCT Pub. No.: WO2008/079091

PCT Pub. Date: Jul. 3, 2008

(65) Prior Publication Data

US 2010/0084414 A1 Apr. 8, 2010

(30) Foreign Application Priority Data

Dec. 22, 2006 (SE) ..... 0602807-0

(51) Int. Cl.
*B65D 5/38* (2006.01)
*B65D 83/04* (2006.01)

(52) U.S. Cl.
CPC ..... *B65D 5/38* (2013.01); *B65D 83/0463* (2013.01); *B65D 2215/02* (2013.01); *Y10T 428/24215* (2015.01)

(58) Field of Classification Search
USPC ..... 220/694, 528; 206/532; 229/125.125; 428/124
See application file for complete search history.

(56) References Cited

U.S. PATENT DOCUMENTS

| | | | | |
|---|---|---|---|---|
| 2,361,984 | A | 11/1944 | Williamson | |
| 2,426,911 | A | 9/1947 | Williamson | |
| 3,332,600 | A | 2/1967 | Guernsey | |
| 3,372,860 | A | 3/1968 | Giurlando | |
| 5,080,227 | A | 1/1992 | Focke | |
| 6,230,893 | B1 * | 5/2001 | Karow | 206/531 |
| 6,491,211 | B1 | 12/2002 | Evans et al. | |

FOREIGN PATENT DOCUMENTS

| | | |
|---|---|---|
| EP | 1002744 | 5/2000 |
| FR | 2649672 | 1/1991 |
| GB | 375694 | 6/1932 |
| WO | 2006068602 | 6/2006 |

* cited by examiner

*Primary Examiner* — Jeffrey R Allen
(74) *Attorney, Agent, or Firm* — Greer, Burns & Crain, Ltd.

(57) ABSTRACT

The disclosure relates to an insert adapted to be slidably received in a sleeve. The insert comprises a base portion, a first flap portion adapted to be refolded about a first fold line, a second flap portion adapted to be refolded about a second fold line, wherein the second fold line extends essentially in parallel with the first fold line, and wherein the first flap portion is refolded in relation to the base portion such that it extends backwardly over a first surface of the base portion, and the second flap portion is refolded in relation to the base portion such that it extends backwardly over a second surface, opposite the first surface, of the base portion. The disclosure also relates to a sleeve adapted to slidably receive such an insert and the thus formed package.

2 Claims, 3 Drawing Sheets

INSERT AND PACKAGE FORMED OF AN INSERT IN A SLEEVE

This application is a U.S. National Phase under 35 U.S.C. § 371 of International Application No. PCT/SE2007/051055, filed Dec. 20, 2007, which claims priority from Swedish Patent Application No. 0602807-0, filed Dec. 22, 2006.

FIELD OF INVENTION

The present invention relates to an insert adapted to be slidably inserted in a sleeve. The insert is provided with a base portion, a first flap portion adapted to be refolded about a first fold line, and a second flap portion adapted to be refolded about a second fold line. The present invention also relates to a package formed of a sleeve and a within the sleeve slidably received insert.

The present invention is especially suitable for, but not limited to, controlled easy-access package for child resistant, senior-friendly storage of unit dose products or the like, carried by an insert.

TECHNICAL BACKGROUND

U.S. Pat. No. 6,491,211 B1 discloses a child resistant carton assembly comprising a package and a tray slidably receivable within the package. The package comprises a top panel and a locking panel arranged in parallel with and at a distance from the top panel, thereby forming a locking chamber together with the top panel. The tray includes a locking panel arranged at the leading edge (leading when the tray is pushed into the package and trailing when the tray is pulled out of the package). The panel is refolded such that a portion of the tab extends into the locking chamber. The package is provided with a cut-out forming a push-button. If the user pulls the tray outwardly without pushing the push-button, the locking panel will enter the locking chamber thereby blocking removal. By pushing the push-button before the tray is pulled out of the package, the user may release the locking panel such that the tray may be pulled out of the package without the locking panel entering the locking chamber. If the locking panel has been released the tray may be removed completely from the package.

EP 1 002 744 A1 discloses a two-piece paperboard container that houses a unit does product on an internal slide card within an outer paperboard shell. This package has two internal locks that prevent the slide card from being pulled out without triggering a lock release mechanism. This package is focused on providing a child resistant, senior-friendly unit dose package that can be opened and closed numerous times and then finally disposed of.

The paperboard shell is formed by folding a blank consisting of three major panels connected in line by two narrow panels. Crease lines are formed at the connection between the respective panels. The major panel being in the centre of the blank is adapted to form a bottom surface of the package. One of the outer major panels of the blank is adapted to form an outer top surface of the package. The other outer major panel of the blank is adapted for form an inner top surface of the package. The inner top surface and the outer top surface are glued to each other. The panel forming the inner top surface is provided with a through-going opening or cut-out. The panel forming the outer top surface is provided with a score line formed as an oval. The panel is cut through along this score line. The oval score line and the through-going opening are positioned on the two outer panels in such a manner that when forming a package the oval score line will be positioned on top of the through-going hole. The portion of the panel being within this oval score line may be pushed as a push-button. The internal slide card is provided with a tab formed at the leading edge (leading when the slide card is inserted into the package and trailing when the slide card is withdrawn from the package). The tab is refolded backwards over the slide card. When the slide card is inserted completely inside the shell, the refolded tab will due to its spring-back properties enter into the through-going opening of the panel forming the inner top surface.

When a user pulls the slide card, the tab will be forced into the through-going opening and thus block the slide card from being pulled out of the package. However, if the user pushes the push-button before starting to pull the slide card out of the package, the tab will be pushed out of the through-going opening and the slide card may thus be pulled out of the package.

At the opening, through which the slide card is inserted into the package, the package disclosed in EP 1 002 744 A1 is, compared to the package disclosed in U.S. Pat. No. 6,491,211 B1, further provided with an inwardly folded tab. This additional tab is adapted to interact with the refolded tab of the slide card to prevent the slide card from being pulled completely out of the package.

Both the prior art packages above is associated with a problem related to the design of the locking mechanisms. Already when the refolded tabs of the tray and slide card, respectively, looses only a portion of its spring-back properties (after being pushed inwardly a few times to release the locking mechanism) it will not make a complete spring-back movement. The design of the package in U.S. Pat. No. 6,491,211 B1 have to balance the locking security with the thickness of the package. By making the thickness or height of the locking chamber greater, the locking security is increased. However, the thickness of the locking chamber is also a thickness of the package that cannot be used to contain the products, thereby increasing the size of the package in an undesired manner. The design of the package in EP 1 002 744 A1 relies on the material thickness of the inner top panel to make sure the locking effect is achieved. If the spring-back movement is not enough for the panel to be caught in the through-going opening in the inner top panel the slide card may be retracted.

The second locking mechanism of EP 1 022 744 A1 is also associated with a similar problem. The locking tab of the slide card is as discussed above repeatedly pushed downwardly whereby it will loose its spring-back properties. The locking tab of the package will by the slide card be forced to abutment to the inside of the inner top panel. This will negatively effect the spring-back movement of this locking tab. When the user tries to completely remove the slide card from the package, the design of the package relies on the spring-back of the two locking panels, but as discussed above the spring-back of both locking panels is negatively affected by the previous use of the package.

WO2006/068602 A1 discloses an improved package design comprising a sleeve and an insert adapted to be slidably received in the sleeve. The insert is provided with one or more flaps providing a first locking means adapted to interact with a first locking means of the sleeve. In the two basic embodiments disclosed in this document, the flaps forming the first locking means are refolded back over the insert about a line extending basically along the sliding direction along which the insert is slidable within the sleeve. These flaps of the first locking means are adapted to interact with a bridge having different shapes in the two basic embodiments. The insert is further provided with a second locking flap refolded in basically the same manner as the locking flap of EP 1 002 744 A1 and U.S. Pat. No. 6,491,211 B1. This second locking flap of the insert is adapted to interact with a locking flap of the sleeve in basically the same manner as in EP 1 002 744 A1 in order to prevent the insert from being completely removed from the sleeve. Since the flaps of the insert forming the first locking means are pushed down several times it may loose its spring-back properties in a similar way as in the EP 1 002 744 A1 and U.S. Pat. No. 6,491,211 B1. However, such a loss of spring-back does, due to the design of the flaps and bridge of the first locking means, not jeopardise the locking functionality to such an extent as in EP 1 002 744 A1 and U.S. Pat. No. 6,491,211 B1. Although improved over EP 1 002 744 A1 and U.S. Pat. No. 6,491,211 B1 also the package of WO2006/068602 A1 may encounter situations where the spring-back movement of the second locking flaps does not offer the desired degree of security against removal of the insert from the sleeve.

Thus, there is a need for an even further improved locking or retaining functionality.

SUMMARY OF INVENTION

It is an object of the invention to provide an insert with an improved retaining functionality.

It is yet another object of the invention to provide a package, comprising a sleeve and an insert slidably received in the sleeve, with an improved retaining functionality.

It may in this context be noted that the insert and sleeve discussed in detail need not be necessarily be combined to form a package. An insert as discussed below may be produced in large quantities and be combined with different kinds of sleeves dependent upon the need for secure locking functionality. By combining an insert as discussed in detail below with a sleeve as discussed in detail below full use of the retaining functionality is achieved.

The above object concerning the insert has been achieved in accordance with the invention by an insert comprising a base portion, a first flap portion adapted to be refolded about a first fold line, a second flap portion adapted to be refolded about a second fold line, wherein the second fold line extends essentially in parallel with the first fold line, and wherein the first flap portion is refolded in relation to the base portion such that it extends backwardly over a first surface of the base portion, and the second flap portion is refolded in relation to the base portion such that it extends backwardly over a second surface, opposite the first surface, of the base portion.

By providing the insert with two flap portions refoldable against both major surfaces of the insert a number of advantages is achieved compared to the prior art designs. Firstly it is possible achieve a centring effect by making the two flap portions slide against opposite inside walls of the compartment formed by the sleeve. Secondly, by arranging the flap portions in the vicinity of each other or directly opposite each other on the insert, i.e. at about or at the same location when viewed in the direction in which the insert is slidable in the sleeve, it is possible to make the flap portions help each other. If one of the flap portions has lost some of its spring-back ability, the other flap portion will urge the insert and the one flap portion towards its retaining mechanism. Thus, not only will the addition of a second retaining mechanism add the security of locking even if the first locking mechanism failure, it will additionally increase the likelihood of the first retaining mechanism as such to lock properly. Thirdly, it is beneficial to have oppositely extending flap portions if one of the flap portions is used both for release from an initial locking mechanism and for preventing complete removal, i.e. forming part of an retaining mechanism. In such a case the flap portion that has been maneuvered repeatedly every time the user has slid the insert partly out of the sleeve is likely to have weakened and lost at least some of its spring-back ability whereas the opposite flap portion has remained unaffected during this normal use and will both securely lock into its retaining mechanism and if arranged opposite the weak flap portion also help the weak flap portion securely lock into its retaining mechanism. Fourthly, by having oppositely extending flap portions it is also possible to make specific use of the fact that many laminated materials, such as paper based materials laminated with one or more polymer layers, are often not symmetrical and has a tendency to have a greater bending stiffness in one direction compared to the other. By balancing the use of different layers of different polymers and/or different layer thicknesses and/or different degrees of orientation of the polymers in the layers it is possible to optimise the sleeve for allowing repeated bending in one direction without loosing spring-back too much and for being strong in the other direction.

Further preferred embodiments of the insert are apparent from the dependent claims.

The first and second fold lines may extend essentially along a single geometrical line. With this design the flap portions will be located in the vicinity of each other as viewed in the direction in which the insert is slidable when inserted in a sleeve, whereby they will be able to help each other as discussed above. Furthermore, if they extend along a single geometrical line production is facilitated e.g. in the creasing step.

The first and second fold line may extend essentially perpendicular to the direction in which the insert is adapted to be slidable when received in a sleeve. With this design the actual fold will form a pocket providing a strong and secure retaining mechanism.

The base portion may comprise two portions refolded against each other about a fold line extending essentially along the direction in which the insert is adapted to be slidable when received in a sleeve. Such a design is especially suitable to use for so-called blister packs. A blister pack has often different bending strength in different directions. By refolding the base portion along a longitudinal line (extending along the sliding direction) both flap portions will be folded in the same direction from a material layer view point when they are refolded against the opposite major surfaces of the refolded base portion. Thereby it is possible to fold both flap portions in the from a material layer view point optimum direction, thereby achieving the optimum spring-back properties for both flap portions. Moreover, the refolding also makes it possible to fold a blister pack such that the blisters of the two portions are tucked in the flat areas between the blisters of the opposing portions.

The insert may further comprise one or more additional locking flaps foldable about one or more fold lines, respectively, extending essentially along the direction in which the insert is adapted to be slidable when received in a sleeve. By combining the flap portions discussed above with the locking flaps of such a kind it is possible to provide the package with one locking mechanism optimised for secure opening of the package (the additional locking flaps) with a retaining mechanism optimised to prevent the insert from being completely removed from a sleeve (the first and second flap portions).

The above object concerning the sleeve has been achieved in accordance with the invention by a sleeve comprising a plurality of panel portions forming a compartment with at least one opening, the compartment being adapted to slidably receive an insert, the insert being slidable at least partly out of the compartment through said opening, wherein a first panel forming a first wall of the compartment is provided with a first retaining means adapted to interact with a first flap portion refolded in relation to a base portion of the insert such that it extends backwardly over a first surface of the base portion, and wherein a second panel forming a second wall, opposite the first wall, of the compartment is provided with a second retaining means adapted to interact with a second flap portion refolded in relation to the base portion of the insert such that it extends backwardly over a second surface, opposite the first surface, of the base portion. Such a sleeve may make use of an insert of the kind discussed above and achieve the advantages discussed above. It may further be used in connection with other inserts with retaining mechanisms facing in two opposite directions.

Further preferred embodiments of the sleeve are apparent from the dependent claims.

The first and/or second retaining means may comprise a flap being refolded backwardly into the compartment and preferably being located in the vicinity of an opening of the compartment through which opening the insert is slidable in and out of the compartment.

The flap may be foldable about a fold line extending essentially perpendicular to the direction in which an insert is adapted to be slidable when received in the compartment of the sleeve.

The first and/or second retaining means may comprise an opening in the first panel, which opening preferably is arranged in the vicinity of an inner end of the compartment.

The retaining means of these different designs may be arranged in different manners to provide different applications of use for the package formed by the sleeve and an insert.

In accordance with one embodiment the sleeve is provided with one panel of the compartment having an through-going opening close to the inner end of the compartment and a refolded flap close to the opening of the compartment, whereas the other panel, opposing the one panel, also having a refolded flap close to the opening of the compartment. With this design a first flap portion of the insert may be used for selectively releasing the insert from being moved at all by releasably locking into the through-going opening, whereas both the first and second flap portions of the insert may prevent complete removal by interacting with the refolded flaps on both sides of the opening thereby forming part of said retaining means.

The sleeve may further comprise a locking panel extending as a bridge into the compartment. In accordance with one embodiment making use of this additional locking panel, the sleeve is provided with a refolded flap on both panels close to the opening as in the embodiment above. The insert is provided with two refolded flaps close to the leading edge (leading when inserted into the sleeve and trailing when being pulled out of the sleeve) interacting with the two refolded flaps of the sleeve. The insert is further provided with a third foldable panel interacting with the additional locking panel of the sleeve.

The locking panel may be foldably connected to a panel forming said compartment along a fold line extending essentially along the direction in which an insert is adapted to be slidable when received in the compartment of the sleeve. The locking panel may be formed in one piece with the blank forming the sleeve or be attached to it by gluing or heat sealing.

The insert discussed in detail above is suitably combined with a sleeve as discussed in detail above thereby forming a package.

The above object concerning the package has also been achieved in accordance with the invention by a package comprising a sleeve and an insert slidably received in the sleeve, the insert comprising a base portion, a first flap portion adapted to be refolded about a first fold line, a second flap portion adapted to be refolded about a second fold line, wherein the second fold line extends essentially in parallel with the first fold line, and wherein the first flap portion is refolded in relation to the base portion such that it extends backwardly over a first surface of the base portion, and the second flap portion is refolded in relation to the base portion such that it extends backwardly over a second surface, opposite the first surface, of the base portion, the sleeve comprising a plurality of panel portions forming a compartment with at least one opening, the insert being slidable at least partly out of the compartment through said opening, wherein a first panel forming a first wall of the compartment is provided with a first retaining means adapted to interact with the first flap portion, and wherein a second panel forming a second wall, opposite the first wall, of the compartment is provided with a second retaining means adapted to interact with the second flap portion.

The advantages of such a package has been discussed in detail above in respect of the design of the insert and in respect of the design of the sleeve.

BRIEF DESCRIPTION OF THE DRAWINGS

The invention will by way of example be described in more detail with reference to the appended schematic drawings, which shows a presently preferred embodiment of the invention.

DETAILED DESCRIPTION OF PREFERRED EMBODIMENTS

Figure 1:
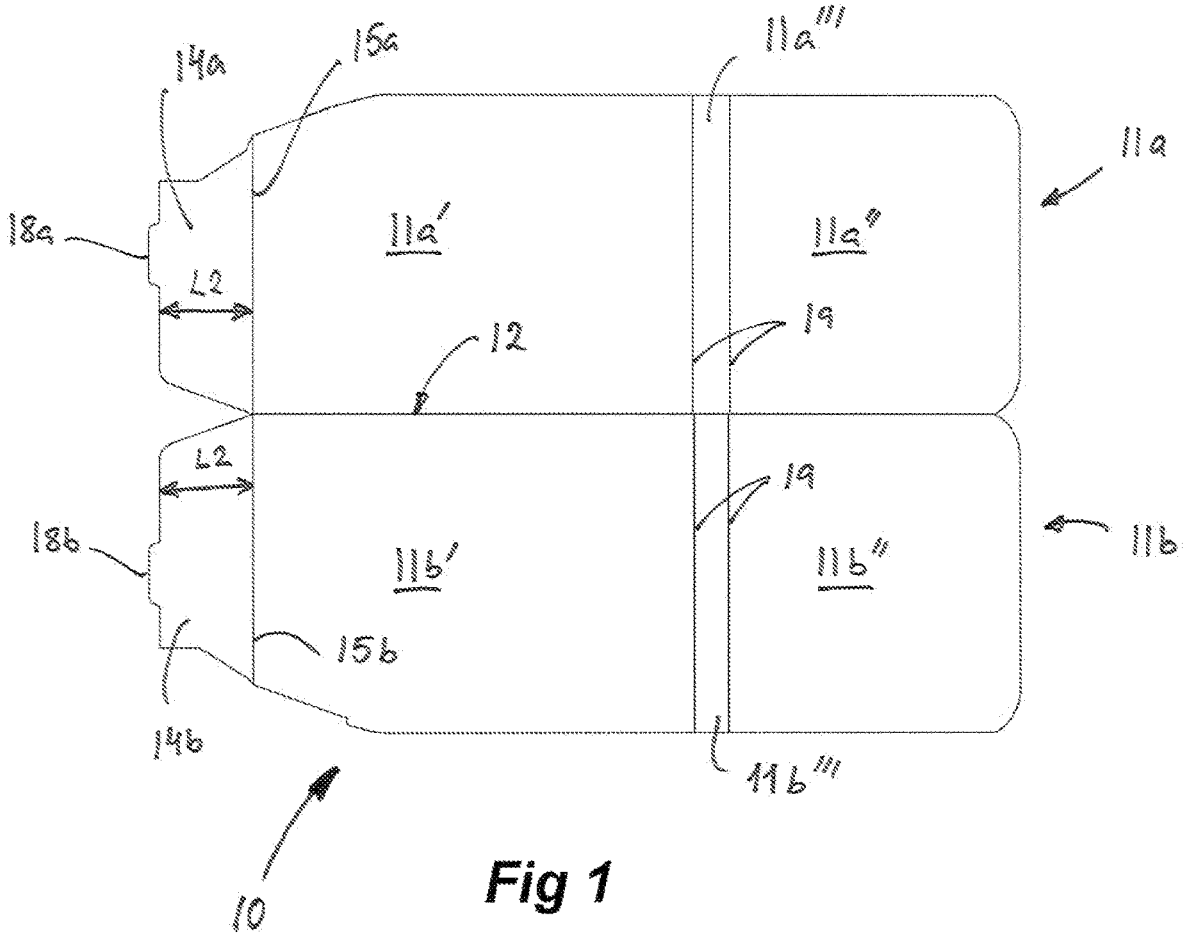
FIG. 1 shows a flat-laid insert.

With reference to FIG. 1, the insert 10 comprises a base portion 11 formed of two portions 11*a-b* foldable towards each other along a fold line 12. The fold line 12 extends in the longitudinal direction; in the direction along which the insert 10 is slidable when received in a sleeve. The two portions 11*a-b* are in turn each formed of two portions 11*a*', 11*a*" and 11*b*', 11*b*" foldable along a set of fold lines 19 defining a small panel 11*a*'", 11*b*'" between the different portions of the base portion 11. The two portions 11*a-b* forming the base portion 11 may be provided with numerous blisters (not shown) containing unit dose products, such as medicine or the like. The insert 10 is further provided with two flap portions 14*a-b* foldably connected to the two portions 11*a-b* forming the base portion 11, respectively, via two fold lines 15*a-b*. The two flap portions 14*a-b* extend in the imaginary extension of respective portion 11*a-b* forming the base portion 11. The two fold lines 15*a-b* extend perpendicularly to the direction in which the insert 10 is slidable when the insert is received in a sleeve. The two fold lines 15*a-b* is perpendicular to the fold line 12. The two fold lines 15*a-b* are parallel to each other and extends along a single geometrical line when the insert 10 is flat-laid. When the base portion 11 of the insert 10 is refolded the two fold lines 15*a-b* will essentially coincide and the two flap portions 14*a-b* will as shown in FIG. 2 be refoldable to extend backwardly along the two major surfaces of the insert 10, one along the first major surface and the other along the second major surface of the insert 10.

Figure 2:
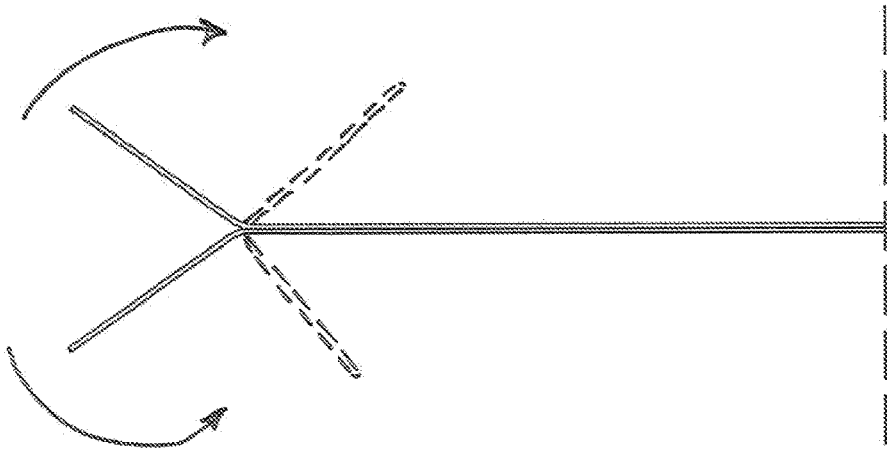
FIG. 2 shows a folded insert.

The insert 10 of FIGS. 1 and 2 may further be provided with an additional locking flap (not shown). This locking flap may be foldable about a fold line extending essentially along the direction in which the insert 10 is adapted to be slidable when received in a sleeve. It will thereby be maneuverable by folding it more or less into the compartment formed by the sleeve.

Figure 3:
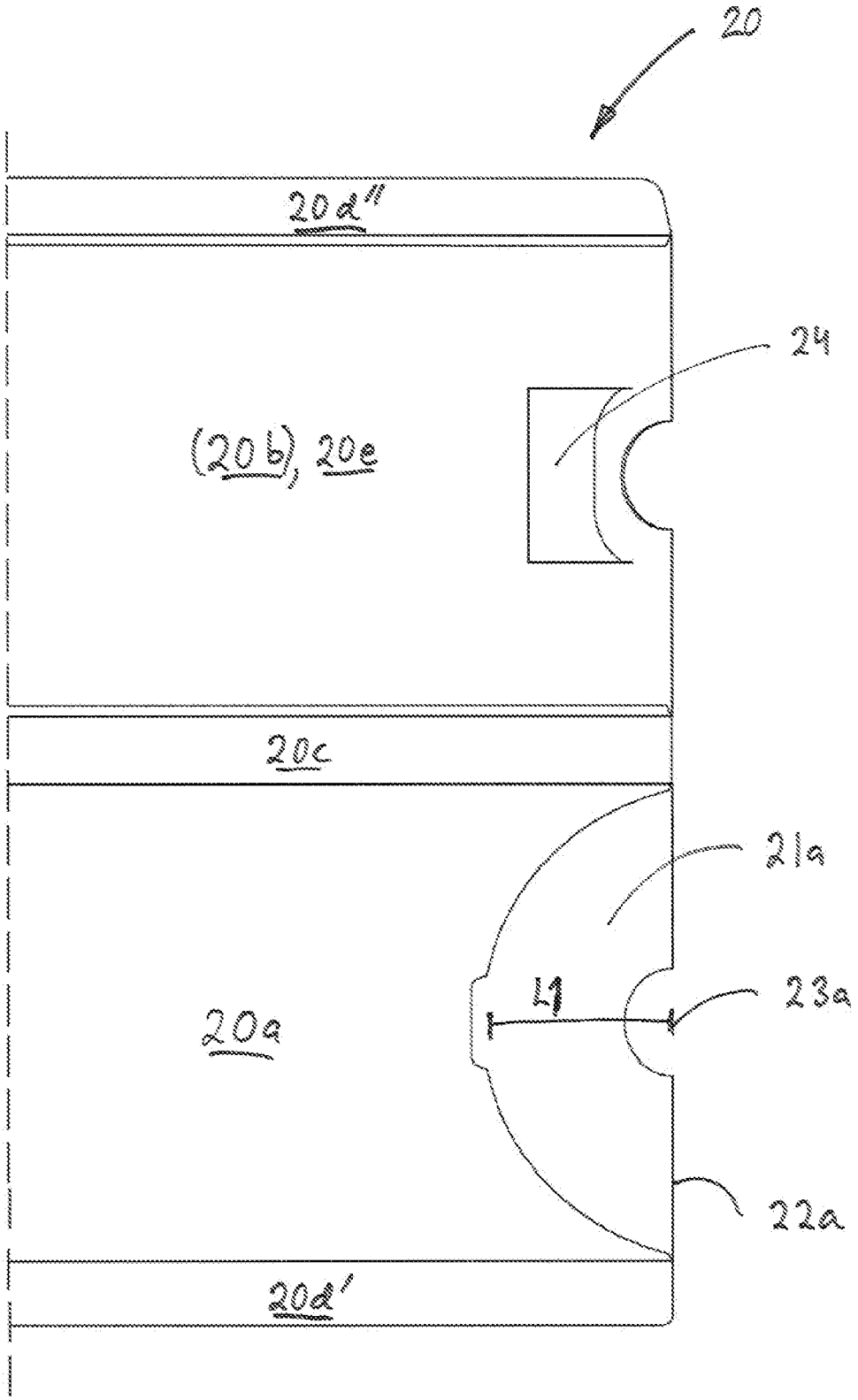
FIG. 3 shows a portion of a flat-laid blank of a sleeve.
Figure 4:
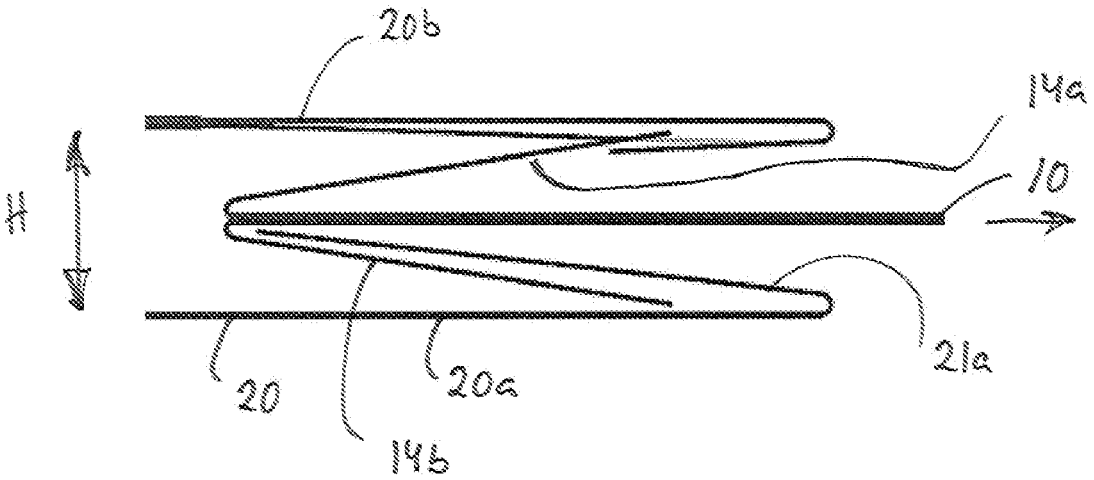
FIG. 4 shows in cross-section a portion of an insert inside a sleeve.

With reference to FIG. 3, the sleeve 20 is formed by folding a blank comprising a first major panel 20*a* and a second major panel 20*b* connected to each other by side panels 20*c-d*. One of the side panels 20*d* is formed of two portions 20*d*' and 20*d*" glued to each other when the sleeve is formed. The blank 20 further comprises a reinforcing panel 20*e* adapted to be refolded and at least partly be glued to the inside of the second major panel 20*b*. In FIG. 3, the reinforcing panel 20*e* has been folded on top of the second major panel 20*b*. When the sleeve 20 is folded the inside of the first major panel 20*a* and the inside of the reinforcing panel 20*e* will together with the insides of the side panels 20*c-d* form a compartment adapted to receive the insert 10. The compartment is basically rectangular in shape and has a height H (as shown in FIG. 4). The compartment has an opening in one end through which the insert 10 may be at least partly removed from the sleeve 20.

In the imaginary extension of the first major panel 20*a*, the sleeve 20 is further provided with a flap 21*a* foldable about fold line 22*a*. The fold line 22*a* is provided with a centrally located slit or opening 23*a*. In FIG. 3 the flap 21*a* has been folded on top of the first major panel 20*a*. The flap 21*a* has a length L1 in the imaginary extension (being refolded into the compartment) exceeding the height H of the compartment.

The reinforcing panel 20*e* is provided with a through-going opening 24 through which one of the flap portions 14*a-b* of the insert 10 is adapted to extend when the insert 10 is almost completely removed from the sleeve 20. The through-going opening 24 is arranged in the vicinity of the opening in the compartment formed by the sleeve 20.

The flap portions 14*a-b* has a total length L2 exceeding the height H of the compartment formed by the sleeve. Preferably each flap portion 14*a*, 14*b* has a total length L2 exceeding the height H of the compartment formed by the sleeve. The length of the flap portions 14*a-b* is measured in the direction perpendicular to the fold line 15*a-b*. In the design in the drawings this direction will be in the same direction as fold line 12. With two flaps 21*a* extending from either side of the opening of the compartment, the total length of the flaps 21*a* may exceed the height H of the compartment, but preferably each flap 21*a* has a length exceeding the height H. By providing the flaps 21*a* of the sleeve 20 and the flap portions 14*a-b* of the insert 10 with this excess length each flap 14*a-b*, 21*a* is prevented from being pivoted from the refolded position without being buckled or otherwise deformed.

At the outer end of each and one of the flap portions 14*a-b* a tongue 18*a-b* is provided. The tongue 18*a* is adapted to enter the slit 23*a*. The tongue 18*a* may be coloured to indicate to the user that the insert 10 cannot be removed any further from the sleeve 20 without damaging the package.

The insert 10 and/or the sleeve 20 may be formed from a paper-based laminate, such as one or more paper layers laminated with one or more layers of polymer, varnish, metal foils, or the like. The insert 10 and/or the sleeve 20 may alternatively be formed from a polymer based material. Other materials with the desired spring-back properties are also contemplated, such as textiles or non-woven materials laminated with polymer layer(s).

The functionality of the retaining means is in detailed shown in FIG. 4. The two flap portions 14*a-b* of the insert 10 are refolded as indicated by the dotted lines in FIG. 2 and will, when the insert 10 is pulled out of the sleeve 20 as indicated by the arrow in FIG. 4, enter into the corner formed of the refolded retaining flap 21*a* and into the opening 24 formed in the reinforcing panel 20*e*, respectively.

It is contemplated that there are numerous modifications of the embodiments described herein, which are still within the scope of the invention as defined by the appended claims.

The reinforcing panel 20*e* may for instance be replaced by a refolded flap extending from the second major panel 20*b* corresponding to the flap 21*a* extending from the first major panel 20*a*.

Alternatively, the reinforcing panel 20*e* may be provided with a through-going opening 24 closely to the end of the compartment opposite the opening of the compartment. One of the flap portions 14*a-b* of the insert 10 may be adapted to releasably extend through the opening 24 when the insert 10 is almost completely inside from the sleeve 20. This will provide an initial locking mechanism that need to be released before the insert 10 is to be slid out of sleeve 20 at all.

The invention claimed is:

1. Insert adapted to be slidably received in a sleeve, the insert comprising a base portion, a first flap portion adapted to be refolded about a first fold line, a second flap portion adapted to be refolded about a second fold line, wherein the second fold line extends essentially in parallel with the first fold line, wherein the first and second fold lines extend essentially along a single geometrical line, wherein the base portion comprises two portions refolded against each other about a fold line extending essentially along the direction in which the insert is adapted to be slidable when received in the sleeve, and wherein the first flap portion is refolded in relation to the folded base portion such that it extends backwardly over a first surface of the base portion, and the second flap portion is refolded in relation to the base portion such that it extends backwardly over a second surface, opposite the first surface, of the folded base portion.

2. Insert according to claim 1, wherein the first and second fold lines extend essentially perpendicular to the direction in which the insert is adapted to be slidable when received in a sleeve.

* * * * *